United States Patent [19]

Besnier

[11] Patent Number: 4,753,557

[45] Date of Patent: Jun. 28, 1988

[54] MONOSKI TEMPLATE AND METHOD OF BORING ORIFICES IN A SKI

[75] Inventor: Bertrand Besnier, Annecy, France

[73] Assignee: Salomon, S.A., Annecy, France

[21] Appl. No.: 920,433

[22] Filed: Oct. 20, 1986

[30] Foreign Application Priority Data

Oct. 24, 1985 [FR] France ..... 85 16080

[51] Int. Cl.[4] ..... B23B 49/02

[52] U.S. Cl. ..... 408/115 R

[58] Field of Search ..... 408/112, 115 R, 115 B, 408/72, 108, 87, 99, 103; 269/254 R

[56] References Cited

U.S. PATENT DOCUMENTS

| | | | |
|---|---|---|---|
| 3,973,860 | 8/1976 | Kern | 408/115 R X |
| 4,188,044 | 2/1980 | Kautzky | 280/611 |
| 4,330,228 | 5/1982 | Beyl | 408/112 |
| 4,377,357 | 3/1983 | Butera | 408/115 R |
| 4,474,514 | 10/1984 | Jensen | 408/115 R |
| 4,594,032 | 6/1986 | Warburg | 408/115 R |

FOREIGN PATENT DOCUMENTS

| | | |
|---|---|---|
| 1453107 | 12/1968 | Fed. Rep. of Germany . |
| 2807279 | 8/1979 | Fed. Rep. of Germany . |
| 1421128 | 11/1965 | France . |
| 2240751 | 3/1975 | France . |
| 2511906 | 3/1983 | France . |
| 0124364 | 8/1979 | Switzerland . |
| 0660412 | 11/1951 | United Kingdom . |

*Primary Examiner*—William Briggs

*Attorney, Agent, or Firm*—Sandler & Greenblum

[57] ABSTRACT

A template and a method for boring orifices in a monoski. The orifices are adapted to receive two bindings. The template includes a base plate supporting boring barrels and two lateral abutments displaceable between two substantially symmetrical positions with respect to the longitudinal vertical and median plane of the base plate. The template also includes an apparatus for pinching the monoski over its thickness. The method includes the steps of positioning the template at a first position on one side of the longitudinal median axis of the monoski, abuting a support surface of the lateral abutments against one lateral side of the ski, drilling holes in the ski at the point at which the boring barrels contact the ski, linearly displacing the template to a second position on the other side of and symmetrical to the longitudinal median axis of the ski, displacing the lateral abutments to a position on the other side of and symmetrical with respect to the longitudinal vertical and median plane of the base plate, abuting the support surfaces of the abutments against the other lateral side of the ski, and drilling holes in the ski at the point of contact between the boring barrels and the ski.

63 Claims, 6 Drawing Sheets

P
16
18
8
24
25
12
14
5
22
6
7a
4
7
17
19
9
13
15
23
124

P
28
34
16
8
32
12
5
30
26
6
7a
4
7

27
9
38
29
131
130
4
139
140

27
34
29
4
17
9
38
6
32
34
29
17
5
6
31
27
13
9
32

MONOSKI TEMPLATE AND METHOD OF BORING ORIFICES IN A SKI

BACKGROUND OF THE INVENTION

1. Field of the Invention

The invention relates to an apparatus and method for boring orifices in a ski which are adapted for use in positioning elements, such as ski bindings on the ski. More particularly, the invention relates to a template and a method for boring orifices in a monoski which are adapted for the positioning of two element assemblies, such as binding elements, on both sides of the median longitudinal axis of the monoski.

2. Description of Background and Relevant Materials

Presently, templates are used for boring holes in skis which permit the attachment of a single-element assembly, such as a front abutment, a heel binding, and a brake apparatus, on the ski. These templates currently in use bore holes in the ski which permit the attachment of this singleelement assembly so that the assembly is substantially aligned along the median longitudinal axis of the ski.

Such templates are described in French Utility Certificate No. 2,511,906, corresponding to French Patent No. 2,240,751 in the name of the Assignee of the present invention.

These templates generally comprise a base plate equipped with boring elements distributed in positions corresponding to the screw holes of the binding elements. Normally, the length of the base plate is adjustable so as to adapt the spacing between the front binding and the rear binding to the size of the boot. Furthermore, a cursor on the base plate permits the positioning of the template longitudinally with respect to the ski. Most often, this cursor is positioned to correspond to the position of a reference point located on the side of the ski.

Templates currently in use also comprise means for integrally attaching the template to the ski, which generally operates by transversely pinching the ski. This attaching means also permits the transverse centering of the template on the longitudinal and median axis of symmetry of the ski.

These templates are adapted to mount a binding element assembly on a traditional ski, i.e. a ski supporting one binding holding one ski boot. In order to ski using traditional skis one must place each boot in a binding on one of the skis. As a result, one uses two traditional skis for skiing.

In addition to traditional skis, another type of ski, a monoski has also been developed. A monoski has two bindings mounted thereon. As a result, a monoski is adapted to support two boots so that the skier need only use one monoski for skiing. More specifically, a monoski supports two binding element assemblies mounted on both sides of the longitudinal median axis of the monoski, in a generally symmetrical fashion. One boot is held in each binding element assembly on the monoski. Each binding assembly is thus offset with respect to the median longitudinal axis of the ski by a distance which can vary from one monoski to another, depending upon the configuration of the monoski and and desired spacing for the boots.

Existing templates are not adapted to mount binding elements on a monoski because they do not allow for positioning the binding elements off-center with respect to the longitudinal median axis of the ski. Furthermore, the attachment pincers of existing templates do not open sufficiently to pinch a monoski whose width is generally more than twice that of a traditional ski.

Nevertheless, it might be possible to model a monoski template on a template for a traditional ski, i.e., a base plate equipped with boring elements for the two element assemblies and a pincer adapted to open very wide to accommodate the entire width of the monoski.

Such a template, however, would be very cumbersome and would not allow for adjustment of the relative position of the two element assemblies, and particularly would not allow for adjusting the relative spacing and the angular orientation of the two element assemblies with respect to the axis of the monoski.

Thus, there is a need for a template for a monoski which is not cumbersome, and which can adjust the relative spacings and angular orientation of the element assemblies with respect to the longitudinal axis of the monoski.

SUMMARY OF THE INVENTION

It is an object of the present invention to provide a template and a method for permitting the attachment of two binding-element assemblies on both sides of the median longitudinal axis of a monoski.

It is another object of the present invention to provide a template and a method which allows for the attachment of the two element assemblies in a substantially symmetrical manner with respect to the median longitudinal axis of the ski, and which can adjust the distance of the two element assemblies from this axis or from the lateral side of the ski.

It is another object of the present invention to provide a template and a method which permits the angle each element assembly forms with the longitudinal median axis of the ski or with the corresponding side of the ski to be adjusted.

It is still another object of the present invention to provide a template for a monoski and a method for boring orifices in a monoski which is not cumbersome, and which can adjust the relative spacings and angular orientation of the element assemblies with respect to the longitudinal axis of the monoski.

Other aims and advantages of the present invention will become evident in the course of the detailed description which follows.

The present invention which achieves these objectives, in one embodiment relates to a template for boring orifices in a ski comprising a base plate; at least one positioning means on the base plate for positioning at least one orifice in the ski; and at least one lateral abutment for laterally retaining the base plate on the ski. The at least one lateral abutment comprises a support surface for supporting a lateral side of the ski and means for permitting displacement of the at least one lateral abutment between first and second positions on either side of and substantially symmetrical with respect to the vertical longitudinal and median plane of the plate.

The template further comprises means for positioning a sufficient number of openings for receiving one binding assembly on a ski adapted to support only the one binding assembly and one boot thereon; and two binding assemblies on a monoski adapted to support two binding assemblies and two boots thereon. In addition, the template further comprises means for removably attaching at least one lateral abutment for attaching the base plate to the ski having the one binding assembly and for removably attaching at least one lateral abutment for attaching the base plate to the monoski.

The at least one positioning means comprises at least one boring barrel comprising means for positioning at least one orifice in a monoski. In this embodiment the template comprises means for permitting the template to be positioned in first and second positions on the monoski. In the first position the base plate is on one side of the median longitudinal axis of the monoski and the support surface rests against one lateral side of the ski. In the second position the base plate is on the other side of the median longitudinal axis of the monoski and the support surface rests against the other lateral side of the ski.

The template further comprises means for permitting displacement of the template between the first and second positions by linearly displacing the base plate from one side to the other side of the median longitudinal axis of the monoski and by displacing the at least one abutment from the first position of the at least one abutment to the second position of the at least one abutment.

The template further comprises means for permitting the reversing of the at least one abutment with respect to the base plate. Reversing of the at least one abutment with respect to the base plate displaces the at least one abutment from the first to the second position of the at least one abutment to the second position of the at least one abutment. In addition, the at least one boring barrel comprises means for positioning at least one orifice in the monoski for receiving an element assembly attached to the monoski.

In one embodiment the template further comprises a plurality of boring barrels positioned on both sides of the vertical longitudinal and median plane of the base plate. The plurality of boring barrels comprise means for positioning a plurality of orifices in the monoski for receiving two element assemblies attached to the monoski. The plurality of boring barrels are positioned symmetrically on either side of the vertical longitudinal and median plane of the base plate. In addition, the plurality of boring barrels comprise means for positioning a plurality of orifices in the monoski for receiving portions of two bindings for holding two boots on the monoski.

In one embodiment the base plate is elongated in shape in the longitudinal direction of the monoski, the base plate further comprises two ends, and the template further comprises two lateral abutments. Each lateral abutment is positioned adjacent a different end of the base plate, and each lateral abutment comprises a support surface. The abutments are attached to the base plate in such a manner that the support surfaces extend substantially parallel to the vertical longitudinal and median plane of the base plate. In addition, the lateral abutments extend outwardly from one of the lateral sides of the base plate.

The template can further comprise means for adjusting the length of the base plate. This adjusting means comprises two half-plates comprising the base plate. The two halfplates are slidingly attached to one another so as to slide in the longitudinal direction on one another. In addition, the adjusting means further comprises means for locking the two half-plates in a plurality of positions with respect to each other. In this embodiment the template further comprises a cursor on the base plate for being aligned with a reference position on the monoski to position the base plate in the desired position on the monoski. The cursor is positioned at one longitudinal edge of the base plate, and the template further comprises a pointer extending transversely over the base plate from the cursor to a longitudinal edge of the base plate opposite from the one longituidnal edge to permit correct longitudinal positioning of the base plate on the monoski.

In another embodiment the template further comprises at least one linkage arm supporting the at least one abutment and attachable to the base plate in two different manners, thereby positioning the support surface in the two positions symmetrically positioned with respect to the vertical longitudinal and median plane of the base plate. The template can further comprise nesting means attached to the at least one linking arm; and complementary nesting means integral with the base plate for engaging the nesting means. The complementary nesting means extends symmetrically with respect to the vertical longitudinal and median plane of the base plate. The at least one linkage arm comprises an end oriented toward the base plate, and the nesting means is attached to the at least one linkage arm at the end. The nesting means comprises a block and two projections extending downwardly from the block, and the complementary nesting means comprises a block and two openings adapted to receive the two projections therein. The vertical longitudinal and median axis of each opening is in the vertical longitudinal and median plane of the base plate. In addition,the nesting means and the complementary nesting means together comprise means for attaching the at least one lateral abutment and the at least one linkage arm to the base plate in two positions which are substantially symmetrical with respect to the vertical longitudinal and median plane of the base plate.

The template can further comprise means for adjusting the position of the at least one lateral abutment on the at least one linkage arm. In this embodiment the at least one lateral abutment comprises a plate having a first opening therein for receiving the at least one linkage arm therethrough and a second threaded opening therein intersecting the first opening. The adjusting means comprises a screw in the threaded opening. The screw is of sufficient length to engage the at least one linkage arm in the first opening, thereby integrally attaching the plate to the at least one linkage arm.

In one embodiment the linkage arm comprises a single shaft. In an alternative embodiment the linkage arm comprises two substantially parallel shafts. In still another embodiment the linkage arm comprises a shaft having a cross-sectional shape selected from the group consisting of: round, rectangular, square, and oblong. In still another embodiment the at least one linkage arm further comprises a graduated scale thereon for facilitating adjustment of the transverse position of the template on the monoski.

In still another embodiment the at least one abutment is journalled on the base plate around a journal axis belonging to the vertical longitudinal and median plane of the base plate. The journal axis, in one embodiment, is a horizontal axis. In this embodiment the template further comprises a linkage arm journalled on the base plate around the horizontal journal axis. The linkage arm pivotally attaches the at least one abutment to the base plate around the horizontal journal axis. In addition, the template further comprises a cap integral with the base plate and a journal pin horizontally mounted on the cap and attached to the at least one linkage arm for pivotally mounting the at least one abutment on the base plate around the horizontal journal axis. The support surface extends above and below the at least one linkage arm in this embodiment. In addition, the majority of the support surface extends from one side of the at least linkage arm, and the at least one abutment is pivotally attached to the at least one linkage arm.

In still another embodiment the journal axis is a vertical pivot axis, and the at least one linkage arm can be pivotally mounted on the base plate around the vertical pivot axis.

In still another embodiment the template further comprises means for attaching the at least one linkage arm to the base plate and means for adjusting the position of the at least one linkage arm on the attaching means. The at least one linkage arm is integrally attached to the at least one abutment in this embodiment.

In addition, the at least one linkage arm comprises at least one shaft having a first end integrally attached to the at least one abutment. The attaching means has an opening therein for receiving the shaft therein. Also, the template further comprises means for locking the shaft to the attaching means at a plurality of points on the shaft, whereby the position of the at least one linkage arm is adjustable with respect to the attaching means.

In another embodiment the template further comprises means for pinching the monoski over the width of the monoski. The at least one lateral abutment comprises a portion of the pinching means. Alternatively, the template can further comprise means for pinching the monoski over the thickness of the monoski.

In another embodiment the template further comprises a substantially C-shaped rider journalled on the base plate around a substantially vertical axis. The rider comprises a substantially vertical arm and upper and lower substantially horizontal arms. The at least one lateral abutment comprises the vertical arm of the rider. The upper horizontal arm comprises a linkage arm supporting the rider on the base plate, and the rider is open in the direction of the base plate. The rider is vertically displaceable along the substantially vertical axis. In addition, the base plate comprises a lower surface, the lower arm comprises an upper surface, and the rider comprises means for pinching the thickness of the monoski between the lower surface of the base plate and the upper surface of the lower arm of the rider. In this embodiment the template can further comprise means for elastically biasing the rider upwardly with respect to the base plate. Also, the template also comprises a shaft comprising a journal for pivotally attaching the rider to the base plate around the substantially vertical axis. The shaft is attached to and extends upwardly from the base plate. The upper arm of the rider has a vertically extending orifice therein for receiving the shaft.

Also provided are means for controlling the vertical position of the rider with respect to the base plate. This controlling means comprises a lever attached to the shaft. Also, the upper arm of the rider comprises an upper surface, and the lever comprises a knob and a lower portion comprising a cam adapted to contact the upper surface of the upper arm of the rider. The cam comprises a flattened portion, and the lever is adapted to be positioned in a lower position and in an upper position with respect to the base plate. Displacement of the lever changes the vertical position of the rider. The lower arm of the rider is displaced to a maximum extent away from the base plate in response to positioning the lever in the lower position. In the lower position the flattened portion contacts the upper surface of the upper arm of the rider. As a result, the cam and the upper arm comprise means for placing the lever in a stable equilibrium position in response to contact between the flattened portion and the upper surface of the upper arm of the rider.

In addition, the vertical arm comprises a projecting tongue projecting therefrom. The tongue comprises a lateral side adapted to contact a lateral edge of the base plate, and means for aligning the lateral side of the tongue with the lateral edge of the base plate when the distance between the lower surface of the base plate and the upper surface of the lower arm of the rider is approximately equal to the thickness of the monoski. The tongue also comprises an upper portion comprising a chamfered surface.

In another embodiment the template further comprises a secondary abutment. The support surface comprises a surface of the secondary abutment, and the support surface is oriented toward the base plate. The secondary abutment is displaceably mounted on the base plate so that the transverse position of the secondary abutment with respect to the base plate is adjustable.

In still another embodiment the invention relates to a template for boring orifices in a ski comprising: a base plate; means for positioning a sufficient number of openings in the ski for receiving one binding assembly on a ski adapted to support only one binding assembly and one boot thereon and two binding assemblies on a monoski adapted to support two binding assemblies and two boots thereon; and means for removably attaching at least one lateral abutment for attaching the base plate to the ski having one binding assembly and for removably attaching at least one lateral abutment for attaching the base plate to the monoski. The invention also relates to this template in combination with the lateral abutments discussed above.

The invention also relates to a method of boring orifices in a ski for the attachment of elements thereto using a template comprising a base plate comprising at least one boring barrel thereon and at least one lateral abutment having a support surface thereon. The method comprises the steps of:

(a) positioning the base plate on one side of the longitudinal median axis of the ski;
(b) positioning the at least one lateral abutment on one side of the longitudinal median axis of the ski and on one side of the longitudinal vertical and median plane of the base plate so that a support surface of the at least one lateral abutment abuts a lateral side of the ski;
(c) making at least one orifice in the ski at a point on the ski determined by the at least one boring barrel;
(d) displacing the base plate to a position on the other side of and substantially symmetrical to the longitudinal median axis of the ski;
(e) displacing the at least one lateral abutment of the template to a position on the other side of and substantially symmetrical to the longitudinal vertical and median plane of the base plate so that the support surface of the at least one lateral abutment abuts the other lateral side of the ski; and
(f) making another orifice in the ski at a point determined by the at least one boring barrel.

In one embodiment the base plate comprises a plurality of boring barrels and two lateral abutments. In this embodiment step (b) comprises the step of positioning the two lateral abutments on one side of the longitudinal median axis of the ski and on one side of the longitudinal vertical and median plane of the base plate so that support surfaces on the two lateral abutments abut a lateral side of the ski. In addition, step (c) comprises the step of making a plurality of orifices in the ski at points on the ski determined by the plurality of boring barrels. Also, step (e) comprises the step of displacing the two lateral abutments to a position on the other side of and substantially symmetrical to the longitudinal vertical and median plane of the base plate so that the support surfaces of the two lateral abutment abut the other lateral side of said ski. Step (f) in this embodiment comprises the step of making another plurality of orifices in the ski at points determined by the plurality of boring barrels.

In another embodiment steps (c) and (f) comprise the steps of extending a drill through said at least one boring barrel and drilling said orifice in said ski.

In still another embodiment step (d) comprises the step of linearly displacing the base plate transversely to the longitudinal median axis of the ski to a position on the other side of and substantially symmetrical to the longitudinal median axis of the ski.

In another embodiment step (b) comprises the step of inserting first and second shafts of a plug attached to the at least one lateral abutment into first and second orifices, respectively, in a block on the base plate. In this embodiment step (e) comprises the step of disengaging the first and second shafts from the first and second orifices, respectively, and inserting the first shaft into the second orifice and inserting the second shaft into the first orifice so as to displacing the at least one lateral abutment of the template to a position on the other side of and substantially symmetrical to the longitudinal vertical and median plane of the base plate so that the support surface of the at least one lateral abutment abuts the other lateral side of the ski.

In still another embodiment step (e) comprises the step of pivoting the at least one abutment around an axis so as to displace the at least one lateral abutment of the template to a position on the other side of and substantially symmetrical to the longitudinal vertical and median plane of the base plate so that the support surface of the at least one lateral abutment abuts the other lateral side of the ski. This pivoting in step (e) can comprise pivoting the at least one abutment around a vertical axis or a horizontal axis. In addition, in another embodiment the method further comprises the steps of pinching the base plate to the monoski before step (c) and again after step (d).

BRIEF DESCRIPTION OF THE DRAWINGS

The invention will be better understood with reference to the detailed description which follows and the attached drawings which form an integral part of the description, in which.

DETAILED DESCRIPTION OF PREFERRED EMBODIMENTS

The template which achieves the goals outlines above comprises a longitudinally extending base equipped with boring barrels. The boring barrels are positioned so as to permit the positioning of an element assembly, such as a binding, on the ski. The boring barrels are positioned on both sides of a longitudinal and median vertical plane of the base plate, which defines the proper direction of each assembly.

Also provided are lateral abutments positioned adjacent to each end of the base plate. The abutments are displaceable and reversible between two substantially symmetrical positions with respect to the longitudinal and median vertical plane of the base plate. Each abutment has a support surface which is substantially parallel to the vertical longitudinal and median plane of the base plate on both sides thereof in such a way that the template can be positioned in two positions on the monoski; in one position the base plate is on one side of the median longitudinal axis of the monoski and the support surfaces of the abutment are positioned against one long, narrow surface of the ski (i.e. one lateral side of the ski) on one side of the axis; in the other position the base plate is positioned on the other side of the longitudinal median axis of the monoski and the support surfaces of the abutments are positioned against the other long, narrow surface of the monoski (i.e. the other lateral side). The displacement of the template from one position to the other position is accomplished by transverse displacement of the base plate and the reversal of the abutments.

Figure 1:
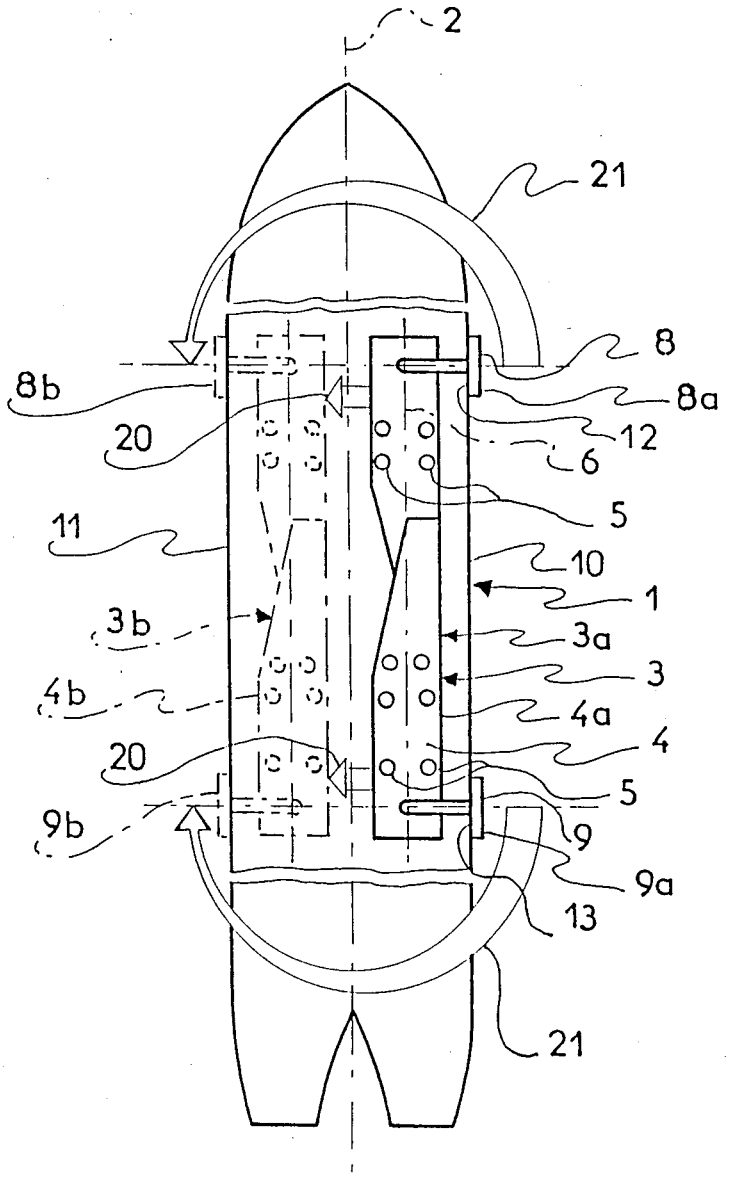
FIG. 1 illustrates a top view of a monoski and the template of the present invention in its two different positions.

FIG. 1 schematically illustrates a top view of a monoski 1 adapted for alpine skiing, which has a longitudinal median axis 2.

In a known fashion, monoski 1 is adapted to be equipped with two element assemblies, such as bindings; one for each foot of the skier, on both sides of its longitudinal median axis 2. These elements assemblies can comprise, for example, a front binding, a heel binding, and if desired a braking apparatus for each assembly.

In order to attach these bindings to monoski 1, a template 3 is used. Template 3 of the present invention comprises a base plate 4 equipped with a plurality of boring barrels 5. Template 3 extends in the longitudinal direction of ski 1. Boring barrels 5 are positioned and dimensioned so as to permit the boring of orifices in monoski 1 at the position of barrels 5. These orifices in ski 1 are adapted to receive and position the elements of an assembly, such as a ski binding on the ski. These orifices are adapted to receive ultimately, for example, binding screws of the elements of the binding.

Boring barrels are distributed on both sides of a vertical longitudinal and median plate P of plate 4, which is orthogonal to base plate 4, and which is defined by dashed line 6 in the horizontal plane of base plate 4, as illustrated in FIGS. 1–5.

The boring barrels are normally distributed in a symmetrical fashion on both sides of vertical and median plane P which defines the proper direction given to the element assembly during its mounting on monoski 1. Furthermore, base plate 4 can have different sets of boring barrels 5 which are adapted for different types of binding elements.

Preferably, base plate 4 also comprises means for adjusting the length of plate 4 to adapt itself to the size of the skier's boot. This length adjusting means is of a known type and will not be described in detail. For example, the length adjusting means can be in the form of two half-plates which comprise base plate 4 and which slide longitudinally on one another and may be latched and locked in a plurality of positions by a lever. This adjusting means also comprises a cursor 7 on one lateral side of base plate 4, whose position depends upon the length to which plate 4 is adjusted. Cursor 7 must be aligned with a reference position of the monoski to position the template longitudinally on the monoski.

If desired, an index 7*a* can be provided. Index 7*a* extends transversely across plate 4 from cursor 7 and permits alignment of the longitudinal position of the template 3 on monoski 1 relative to the two longitudinal edges of the base plate 4.

In a preferred embodiment template 3 further comprises in the vicinity of or at each of its ends, lateral abutments 8, 9. Abutments 8, 9 comprise, respectively, support surfaces 12, 13 which are adapted to rest on either lateral side 10, 11 of the monoski 1 by reversing the position of abutments 8 and 9 shown in FIGS. 2–7. Surfaces 12, 13 hold template 3 on ski 1 so that boring barrels 5 are positioned at a predetermined location at which the ski will be bored with orifices. These orifices are adapted to receive a portion of the element assemblies to be attached to the ski.

Each lateral abutment 8, 9 is displaceable with respect to vertical longitudinal and median plane P of base plate 4 between two substantially symmetrical positions with respect to the median plane P. In these two positions support surfaces 12, 13, are positioned under base plate 4 and extend substantially parallel to longitudinal and median plane P. These two positions are schematically shown in FIG. 1 at 3*a* and 3*b* for template 3.

In one of the positions 3*a* of template 3, base plate 4 is positioned at position 4a on one side of longitudinal median axis 2 of monoski 1 and abutments 8, 9 are positioned at positions 8*a*, 9*a*, respectively with their support surface 12, 13 applied against side 10 of monoski 1 adjacent to base plate 4. In the other position 3*b* of template 3 shown in dashed lines in FIG. 1, base plate 4 is at position 4*b* on the other side of longitudinal median axis 2 and abutments 8, 9 are positioned at positions 8*b*, 9*b*, with their support surface 12, 13 being applied against the other side 11 of monoski 1.

To displace template 3 from one position to the other on the monoski, template 3 is simply translated transversely to axis 2 of ski 1 in the direction of arrow 20 and abutments 8, 9 are displaced to a position on the other side of plane P, substantially symmetrical with respect to median plane P of base plate 4, as is shown schematically by arrows 21 in FIG. 1. The two positions of template 3 correspond to the assembly positions at which the element assemblies, e.g., the binding, will be positioned on ski 1. As a result, the element assemblies can be positioned symmetrically with respect to longitudinal axis 2 of monoski 1.

Figures 2, 2A:
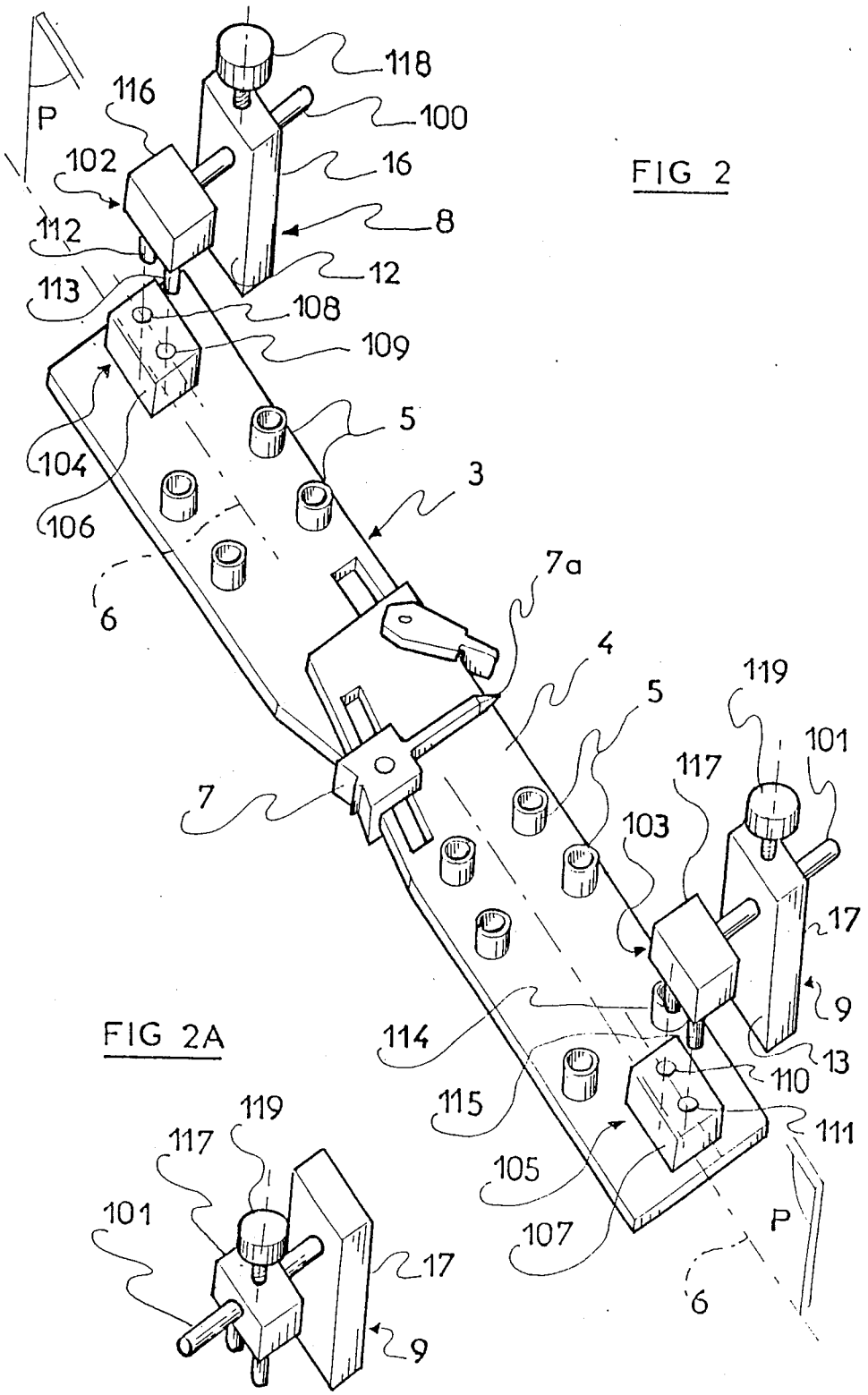
FIG. 2 illustrates a perspective view of a template in one non-limiting embodiment of the invention.
FIG. 2A illustrates a perspective view of an alternative embodiment of abutment 9.

In a first embodiment of template 3 illustrated in Fig. 2, abutments 8 and 9 can be mounted by reversible nesting on base plate 4 in a symmetrical fashion with respect to median plane P. Abutments 8 and 9 are, for example, carried by transverse linkage arms 100, 101, respectively. The end of arms 100, 101 opposite from abutments 8 and 9 are oriented towards base plate 4, and are adapted to be attached to a nesting apparatus 102, 103 which is adapted to cooperate with a complementary apparatus 104, 105 that is integral with base plate 4.

Linkage arms 100, 101 extend substantially orthogonally to support surfaces 12 and 13 of abutments 8 and 9.

Nesting apparatus 102, 103 of linkage arms 100, 101 is adapted to be nested in the complementary apparatus 104, 105, respectively, in substantially symmetrical positions with respect to longitudinal and median vertical plane P of base plate 4 so that each support surface 12 and 13 of abutments 8 and 9 is also adapted to be positioned in substantially symmetrical positions on either side of plane P. When nesting apparatus 102, 103 and abutments 8 and 9 are in these substantially symmetrical positions, support surfaces 12 and 13 are substantially parallel to median plane P.

Complementary nesting apparatus 104 and 105 of base plate 4 extends symmetrically with respect to median plane P. Complementary nesting apparatus 104, 105 also comprises blocks or plugs 106, 107, respectively, which are integral with base plate 4. Blocks 106, 107 have, respectively, two orifices 108 and 109, 110 and 111, therein. The orifices are substantially identical and have vertical longitudinal and median axes passing through the center thereof that belong to median plane P.

The nesting apparatus of each abutment 8, 9 is carried by the end of its respective linkage arm 100, 101 that is opposite from the end supporting abutments 8,9. Nesting apparatus 102, 103 comprises a block or plug 116, 117, respectively, comprising two shafts 112 and 113, 114 and 115, respectively, extending from the bottom thereof. These shafts are substantially identical to each other and are adapted to engage orifices 108 and 109, 110 and 111, respectively, of corresponding blocks 106, 107 of base plate 4.

The nesting of shafts 112-115 in orifices 108-111 can be accomplished in two different positions in which arms 100, 101 and abutments 8, 9 are positioned substantially symmetrically on each side of the median plane P. The first position is illustrated in solid lines in FIG. 2. In the second position arms 100, 101 extend to the left of plane P and support surfaces 12, 13 abut the left lateral side of plate 4 when FIG. 2 is viewed right-side-up. Displacement of abutments 8,9 between these two positions is accomplished by merely reversing abutments 8,9.

It is within the scope of the present invention to use any other complementary nesting means which allows for such a symmetrical positioning of abutments 8 and 9, arms 100, 101, and support surfaces 12, 13 on either side of plane P.

Preferably, the invention further comprises means for adjusting the position of abutments 8, 9, and the length of linkage arms 100, 101. For example, abutments 8 and 9 can comprise, as illustrated in FIG. 2 small plates 16, 17, and linkage arms 100, 101 can comprise rounded shafts which extend through a first guiding orifice in corresponding small plates 16, 17. Plates 16, 17 further include a second, orifice, which is threaded and which intersects the first orifice. This second, threaded orifice is adapted to receive an apparatus such as a screw 118, 119 which extends through the second threaded orifice to arms 100,101 to integrally attach the small plates with the linkage arm once the adjustment has been performed.

Each linkage arm can comprise a single shaft or two substantially parallel shafts in a fashion that allows the small plate to slide only along the length of its linkage arm.

The linkage arms can also comprise shafts having different cross-sections, e.g., square, rectangular, oblong, or other shaped cross-sections.

FIG. 2A shows a alternative embodiment of abutment 9. In this embodiment one end of linkage arm 101 is integral with abutment 9. Arm 101 is adapted to slide towards its other end in a guidance orifice in block 117 which carries nesting shafts 114, 115. Also provided is a locking screw 119 extending through a threaded opening in plug 117 which intersects the guidance orifice in block 117. Screw 119 is long enough to extend through its threaded opening to the guidance orifice and to arms 101 to lock block 117 in a particular location on arm 101.

If desired, linkage arms 100, 101 can be graduated to facilitate the transverse adjustment of the template 3 on monoski 1.

In the embodiments shown in FIGS. 3–7 abutments 8 and 9 are connected to the base plate by a journal around a journal axis. The journal axis is positioned in vertical longitudinal and median plane P of base plate 4.

Figures 3, 3A:
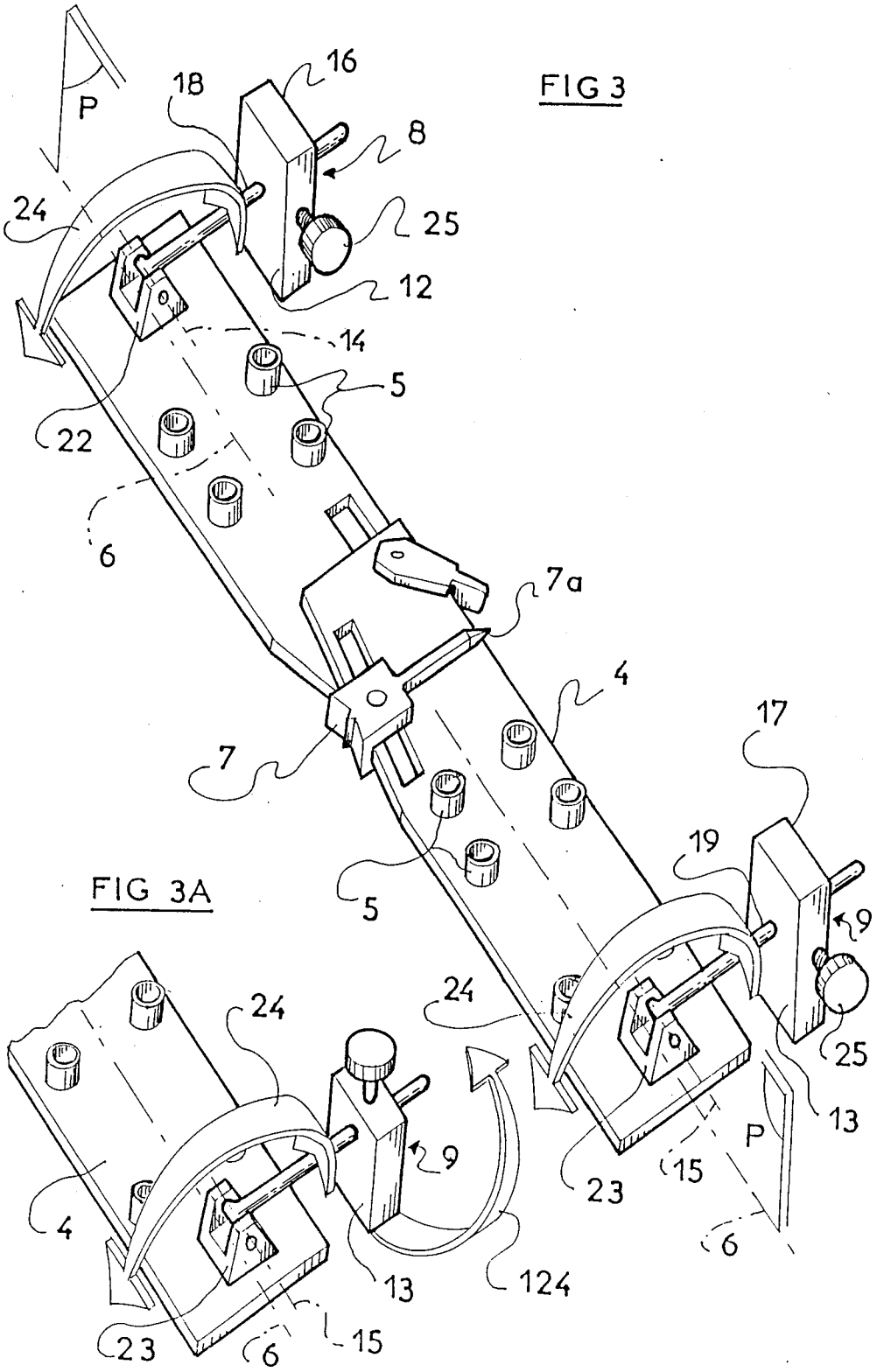
FIG. 3 illustrates a perspective view of a template according to one alternative embodiment of the invention.
FIG. 3A illustrates a perspective view of an alternative embodiment of the template of FIG. 3.

In the embodiment shown in FIG. 3, abutments 8 and 9 are journalled to pivot with respect to a horizontal axis 14, 15 of the median vertical plane P between two substantially symmetrical positions with respect to the median plane P. In these two positions support surfaces 12, 13 of abutments 8, 9 either abut against side 10, or side 11 of monoski 1. One of these positions is shown in FIG. 3 and the pivoting of the abutments to the other position is schematically shown by the arrows 24. Each abutment 8, 9 is connected by a linkage arm 18, 19 to its journal 14, 15 which can comprise, for example, a pin, carried by a cap 22, 23 which is integral with plate 4. Linkage arms 18, 19 extend orthogonally to support surfaces 12, 13 of abutments 8, 9 and preferably the template comprises means for adjusting the position of each abutment along its linkage arm. For example, in the embodiment illustrated in FIG. 3 the abutments can comprise small plates 16, 17 and linkage arms 18, 19 can comprise shafts of rounded cross-section extending through a guidance orifice of small plate 16, 17. In addition, the small plates can also comprise a threaded opening intersecting the guidance orifice and adapted to receive an apparatus such as a locking screw 25 of the small plate on the linkage arm for locking small plate 16, 17 at a particular position on arms 18, 19 by extending through the threaded opening to arms 18, 19.

It is within the scope of the invention to use any other appropriate means for locking the small plate on arms 18, 19, such as a collar mounted on the linkage arm against which the small plate abuts.

If desired, linkage arms 18, 19 can be graduated to facilitate the transverse positioning of the template on the monoski.

To assure the reversibility of the abutments 8, 9, as well as the rotation of linkage arms 18, 19, each small plate 16, 17 has a support surface 12, 13 which extends on both sides of the linkage arms 18, 19.

According to an alternative embodiment of arm 19 shown in FIG. 3A small plate 17 extends principally from one side of linkage arm 19 and can rotate around the axis defined by linkage arm 19 as shown by arrow 124. In this manner, for each position of linkage arm 18, 19, each abutment 8, 9 furnishes, after undergoing a rotation in reverse direction 24, a support surface 12, 13 abuting each side 10, 11 of monoski 1.

Figures 4, 4A, 4B:
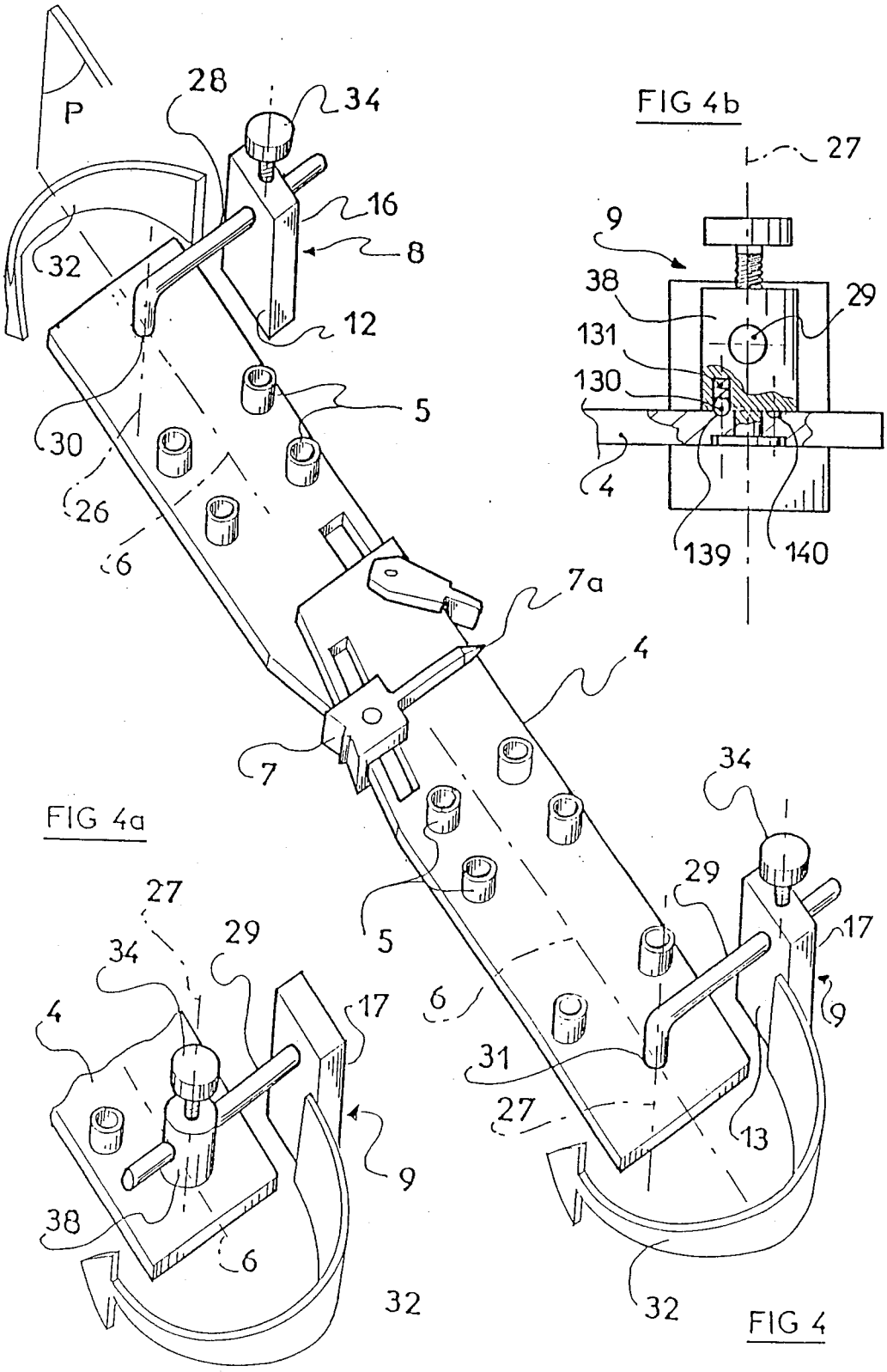
FIG. 4 illustrates a perspective view of another embodiment of the template of the present invention.
FIG. 4A illustrates a perspective view of an alternative embodiment of abutment 9.
FIG. 4B is a side view of FIG. 4A partially cross-sectioned through plane B and illustrates an alternative embodiment.

FIG. 4 illustrates an alternative embodiment of template 3 according to which abutments 8 and 9 are journalled on base plate 4 around a vertical rotation axis 26, 27 of vertical and median plane P of base plate 4.

Abutments 8 and 9 are connected by linkage arms 28, 29 to their journal axis 26, 27, and each support surface 12, 13 is substantially orthogonal to the projection in a horizontal plane of the general direction of its linkage arm 28, 29.

For example, as is shown in FIG. 4, linkage arms 28, 29 can comprise a vertically extending portion extending through a vertical guidance orifice 30, 31 of plate 4, and a horizontally extending portion, at right angles to the vertically extending portion, and on which abutments 8, 9 are supported. Vertical journal axes 26, 27 pass through the vertically extending portion and the vertically extending portion comprises the vertical journal of abutments 8, 9.

As in the preceeding embodiment, the position of samll plates 16, 17 which comprise abutments 8, 9 can be adjusted by adjustment means along arms 28, 29, and the locking of abutments 8, 9 on arms 28, 29 can be accomplished for example by a screw 14.

According to the embodiment of the abutment illustrated in FIG. 4A one end of linkage arm 29 is integral with small plate 17. The other portion of arm 29 extends through a guidance orifice in an element of plug 38 in which is can slide. Element 38 is jounalled on base 4 to rotate around axis vertical axis 27 with respect to base plate 4. Locking screw 34, if it is used, is mounted on element 38.

Because the journal axes are positioned in the longitudinal and median vertical plane P of base plate 4, support surfaces 12, 13 of abutments 8, 9 can occupy two symmetrical positions with respect to vertical median plane P in which abutments 8, 9 abut against each side 10, 11 of monoski 1. One of these positions is substantially that which is shown in FIG. 4, and the displacement of abutments 8, 9 from this position to the other symmetrical position is schematically shown by the arrows 32.

The ends of base plate 4 are shaped in a manner so as to allow for the rotation of abutments 8, 9 around their vertical axes 26, 27 over at least one half a turn, i.e., 180°.

If desired, as is illustrated in FIG. 4B, an apparatus such as a small ball pressurized by a spring 131 and positioned in the base 38 cooperates with two notches 139, 140 in plate 4 so as to produce a resistance point during the rotation of each linkage arm 28, 29 around its axis 26, 27 at each of its two symmetrical positions.

Preferably, in addition to abutments 8, 9, template 3 further comprises means for pinching the monoski over its thickness or over its width thereby immobilizing the template at the upper surface of the monoski, for example, for the boring operation.

For the embodiments which integrally attach the templates with the monoski shown in FIGS. 2–4, any appropriate tightening means which functions by pinching may be used; for example, traditional means of the clamp type, the press type, or an elastic connection can be used, as long as the means pinches the monoski over its thickness or its width.

In the embodiments in which the means for integrally attaching the template 3 with monoski 1 acts by pinching the monoski over its width, abutments 8, 9 can comprise a portion of the pinching means. Preferably, in the embodiments in which abutments 8 and 9 rotate about a vertical rotation axis the pinching means for pinching the thickness of the monoski is combined with abutments 8 and 9.

Figure 5:
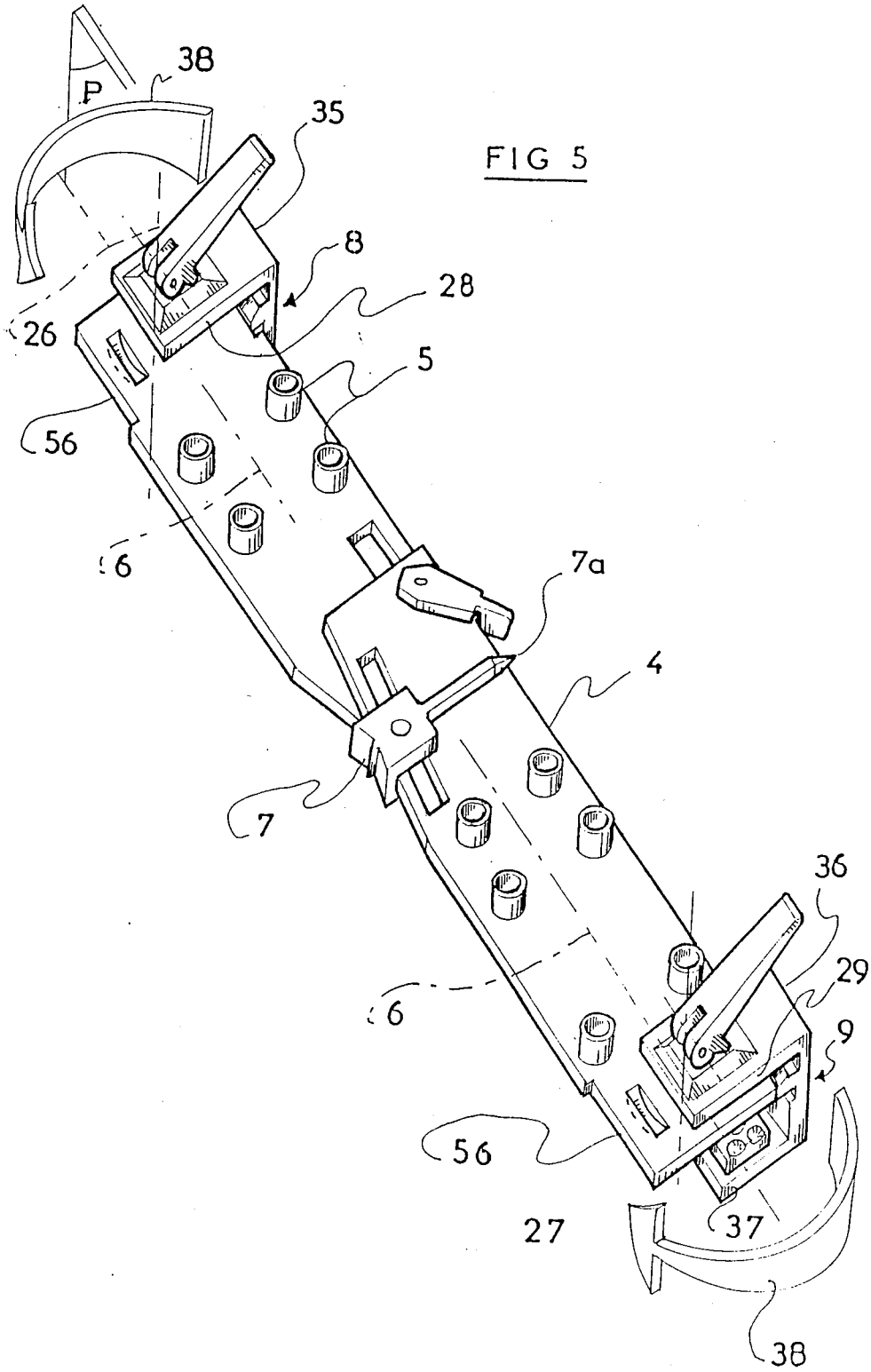
FIG. 5 illustrates a perspective view of another alternative embodiment of the template of the present invention.

In the embodiment illustrated in FIG. 5, a rider 35, 36 is attached to each end of base plate 4. Riders 35, 36 are in substantially the shape of a C that is open in direction of base plate 4. Plate 4 is engaged between the two horizontal arms of riders 35, 36. The vertical arm of the riders 35 and 36 comprises abutments 8 and 9; the upper horizontal arm comprises linkage arm 28 and 29. Toward the bottom of the vertical arm a projecting arm 37 extends horizontally therefrom. Projection 37 has an upper substantially horizontal surface 39 which extends substantially beyond plane P. This surface can be covered with a layer of flexible material 40.

Riders 35 and 36 are pivotable around their vertical axes 26, 27, respectively, between two symmetrical positions with respect to the longitudinal and median vertical plane P. FIG. 5 shows riders 35, 36 in one of these two positions, and displacement to the other position is schematically shown by the arrows 38. Riders 35 and 36 are, furthermore, vertically displaceable along vertical axes 26 and 27, and they are elastically biased upwardly with respect to base plate 4 so as to elastically pinch the thickness of monoski 1 between the lower surface of base plate 4 and upper surface 39 of lower projection arm 37 of the riders 35, 36.

If desired, the upper surface of the monoski 1 can come into contact not with the lower surface of base plate 4 but with flaps 41 which project downwardly from this surface.

Figure 6:
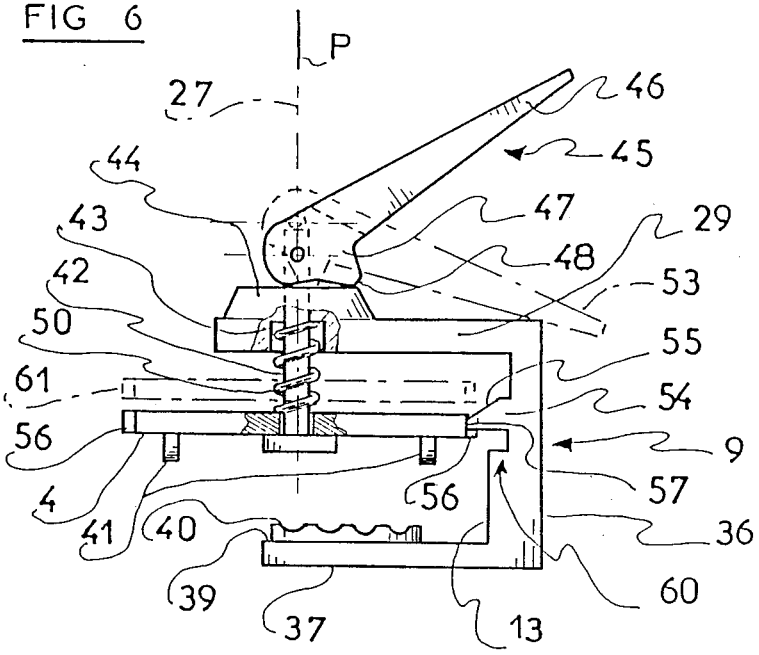
FIG. 6 illustrates a front view of the template illustrated in FIG. 5.

As is shown in FIG. 6, rotation axes 26, 27 of riders 35, 36 are preferably formed, respectively, by a shaft 42 extending upwardly from base plate 4 and slidably mounted in a guidance orifice 43 of the horizontal upper arm of the riders. The thickness of the horizontal upper arm of the riders may be reinforced at this level by a bump 44. At the upper end of each shaft 42 is journalled a manipulation lever 45 which controls the vertical movement of the shaft. In addition, lever 45 can comprise a handle or knob 46 and a lower portion having the configuration of a cam 47 which rests on the upper surface of bump 44.

For each rider a compression spring 50, which extends through shaft 42, is positioned between base plate 4 and the horizontal upper arm ofo the rider. Each spring 50 elastically biases the corresponding rider 35 and 36 towards the top with respect to base plate 4 and thus causes the elastic pinching of the thickness of the monoski 1.

Lever 45 is adapted to be positioned in an upper position and a lower position, schematically shown by dashed lines 53 which corresponds to the maximum opening of the pinching means. Base plate 4 is shown in this position in dashed lines 61, and corresponds also to the maximum compression of springs 50. In this position, if desired, cams 47 of levers 45 can comprise a flattened portion 48 which, by being in contact with the upper surface of bump 44, assures a stable equilibrium position for the levers. The levers can thus be activated by an operator, by a simple movement of the hands which close on each side of the lever and the rider.

Preferably, the vertical arm of each rider 35, 36 has on each side of base plate 4 a projecting tongue 54 directed toward plate 4. Each projecting tongue 54 is situated at the height of base plate 4 when the opening of the pinching means corresponds to the thickness of the monoski. A lateral side 57 of tongue 54 cooperates with an edge of the base plate in order to align the support surfaces 12 or 13 of abutment 8 or 9 against the edge which is substantially parallel to vertical median plane P of base plate 4. A slight play can however exist at this level.

Tongues 54 may, if desired, have a chambered portion 55 in their upper portion which facilitates the alignment on contact with the edge of base plate 4. Preferably, the vertical arm of each rider also comprises a horizontal disengagement groove 60 under tongue 54. In addition, base plate 4 can also comprise a cut-out portion 56 at each corner. Cut-out portion 56 cooperates with the tongues 54 for the alignment of their abutments 8, 9.

As a result of this structure, the rotation of each rider 35, 36 around its vertical axis 26, 27 is facilitated when levers 45 are in their lowered position and plate 4 is above the level of the tongues 54.

Figure 7:
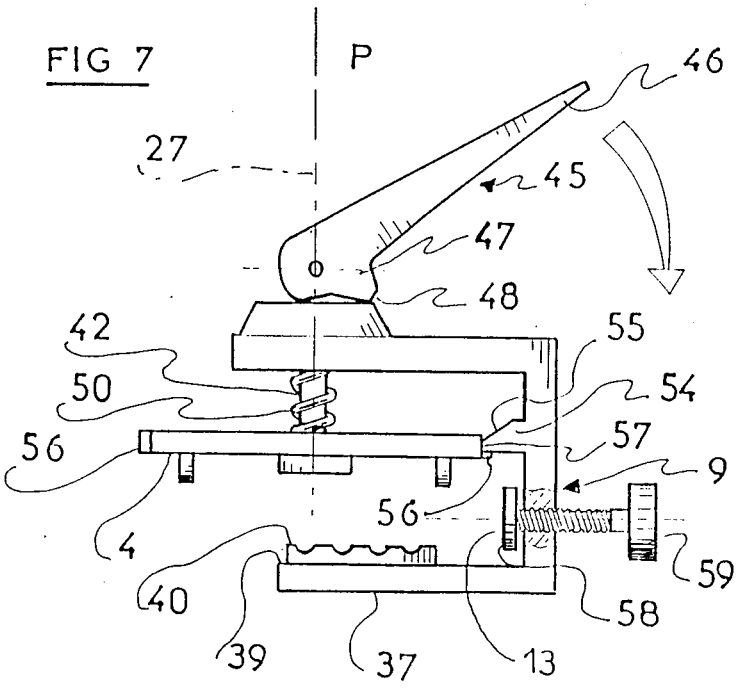
FIG. 7 illustrates an alternative embodiment of the template illustrated in FIG. 6.

FIG. 7 illustrates an alternative embodiment of template 3 at the level of abutment 9. According to this alternative embodiment, in addition to the various elements illustrated in FIGS. 5 and 6, riders 35 and 36 have support surfaces 12 and 13 whose position can be adjusted in a transverse direction. As is shown in FIG. 7, each support surface 12, 13 is a surface oriented towards base plate 4 of a secondary abutment 58 which is transversely adjustable, for example, by a screw 59 which extends through a tapped orifice of the lateral corresponding abutment 8, 9.

It is within the scope of the invention to use any other appropriate means to adjust the transverse position of abutment 58.

It must be emphasized that such an apparatus, as well as the means for adjusting the position of the abutments 8 and 9 along length of the arms 100, 101, 18, 19 and 28, 29 for the templates of the FIGS. 2–5, makes it possible to adjust the position of base plate 4 with respect to each side of the monoski.

This apparatus also makes it possible to adjust the angle between the longitudinal median axis of monoski 1 and vertical longitudinal median plane P of base plate 4, so that the proper direction and orientation can be given to each element assembly on the monoski 1 relative to the longitudinal median axis of the monoski or, on each side, relative to the direction defined by the sides 10 and 11 of the monoski.

Finally, the template of the invention makes it possible to position two element assembles, for example bindings, in a substantially symmetrical manner with respect to longitudinal median axis 2 of the ski 1. Indeed, the template is transversely positioned by means of its abutments 8, 9 and their support surface 12, 13 by using sides 10, 11 of the monoski as a reference. In addition, the template can be positioned in a longitudinal direction either according to a transverse line traced on the monoski originally or by the operator, or according to two reference points situated on each side of the plates.

In order to symmetrically position binding element assemblies on monoski 1, it suffices to position cursor 7 of the template on the line or lateral reference points at various positions on the ski, with additional abutments 8, 9 resting on each of the sides 10, 11.

Naturally, the present description is not given other than by way of example and one could adapt other means of performing the invention without going beyond the scope of the invention.

In particular, one can note that base plate 4 can also be used as a traditional template for a traditional narrow ski holding one binding. It is within the scope of the invention to use means of assembling abutments 8, 9 on base plate 4 which are disassemblable in a manner so as to be able to interchange these abutments with traditional pinching means for narrow skis. In this manner, a single base plate 4 also allows for the mounting of a binding assembly on a narrow, traditional ski as well as the assembly of two binding assemblies on a monoski.

It should be understood that although the invention has been described with respect to particular means, methods and embodiments, that the invention is not limited thereto, but extends to all equivalents within the scope of the claims.

What is claimed is:

1. A template for boring orifices in a ski comprising:

(a) a base plate;

(b) at least one means for positioning boring-tool-receiving orifices on said base plate;

(c) at least one lateral abutment for laterally retaining said base plate on said ski, wherein said at least one lateral abutment comprises a support surface for supporting a lateral side of said ski and means for permitting displacement of said at least one lateral abutment between first and second positions on either side of and substantially symmetrical with respect to the vertical longitudinal and median plane of said plate.

2. The template defined by claim 1 further comprising:

a sufficient number of positioning means for positioning a plurality of said orifices on said ski for receiving:

one binding assembly on a ski adapted to support only said one binding assembly and one boot thereon; and two binding assemblies on a monoski adapted to support two binding assemblies and two boots thereon; and means for removably attaching at least one lateral abutment for attaching said base plate to said ski having said one binding assembly and for removably attaching at least one lateral abutment for attaching said base plate to said monoski.

3. The template defined by claim 1 wherein said at least one positioning means comprises at least one boring barrel comprising means for positioning at least one orifice in a monoski, wherein said template comprises means for permitting said template to be positioned in first and second positions on said monoski, wherein in said first position said base plate is on one side of the median longitudinal axis of said monoski and said support surface rests against one lateral side of said ski, wherein said second position said base plate is on the other side of said median longitudinal axis of said monoski and said support surface rests against the other lateral side of said ski.

4. The template defined by claim 3 further comprising means for permitting displacement of said template between said first and second positions by linearly displacing said base plate from one side to the other side of said median longitudinal axis of said monoski and by displacing said at least one abutment from said first position of said at least one abutment to said second position of said at least one abutment.

5. The template defined by claim 4 further comprising means for permitting the reversing of said at least one abutment with respect to said base plate, wherein reversing of said at least one abutment with respect to said base plate displaces said at least one abutment from said first to said second position of said at least one abutment.

6. The template defined by claim 5 wherein said at least one boring barrel comprises means for positioning at least one orifice in said monoski for receiving an element assembly attached to said monoski.

7. The template defined by claim 6 further comprising a plurality of boring barrels positioned on both sides of said vertical longitudinal and median plane of said base plate, wherein said plurality of boring means comprise means for positioning a plurality of orifices in said monoski for receiving two element assemblies attached to said monoski.

8. The template defined by claim 7 wherein said plurality of boring barrels are positioned symmetrically on either side of said vertical longitudinal and median plane of said base plate.

9. The template defined by claim 8 wherein said plurality of boring barrels comprise means for positioning a plurality of orifices in said monoski for receiving portions of two bindings for holding two boots on said monoski.

10. The template defined by claim 9 wherein said base plate is elongated in shape in the longitudinal direction of said monoski, wherein said base plate further comprises two ends, wherein said template further comprises two lateral abutments, wherein each lateral abutment is positioned adjacent a different end of said base plate, wherein each lateral abutment comprises a support surface.

11. The template defined by claim 10 wherein said abutments are attached to said base plate in such a manner that said support surfaces extend substantially parallel to said vertical longitudinal and median plane of said base plate.

12. The template defined by claim 11 wherein said lateral abutments extend outwardly from one of said lateral sides of said base plate.

13. The template defined by claim 7 further comprising means for adjusting the length of said base plate.

14. The template defined by claim 13 wherein said adjusting means comprises two half-plates comprising said base plate, wherein said two half-plates are slidingly attached to one another so as to slide in the longitudinal direction on one another, wherein said adjusting means further comprises means for locking said two half-plates in a plurality of positions with respect to each other.

15. The template defined by claim 14 further comprising a cursor on said base plate for being aligned with a reference position on said monoski to position said base plate in the desired position on said monoski.

16. The template defined by claim 15 wherein said cursor is positioned at one longitudinal edge of said base plate, wherein said template further comprises:

a pointer extending transversely over said base plate from said cursor to a longitudinal edge of said base plate opposite from said one longitudinal edge to permit correct longitudinal positioning of said base plate on said monoski.

17. The template defined by claim 7 further comprising:

at least one linkage arm supporting said at least one abutment and attachable to said base plate in two different manners, thereby positioning said support surface in said two positions symmetrically positioned with respect to said vertical longitudinal and median plane of said base plate.

18. The template defined by claim 17 further comprising:

nesting means attached to said at least one linking arm; and complementary nesting means integral with said base plate for engaging said nesting means.

19. The template defined by claim 18 wherein said complementary nesting means extends symmetrically with respect to said vertical longitudinal and median plane of said base plate.

20. The template defined by claim 19 wherein said at least one linkage arm comprises an end oriented toward said base plate, wherein said nesting means is attached to said at least one linkage arm at said end.

21. The template defined by claim 20 wherein said nesting means comprises:

a block; and two projections extending downwardly from said block; wherein said complementary nesting means comprises:

a block; and two openings adapted to receive said two projections therein.

22. The template defined by claim 21 wherein the vertical longitudinal and median axis of each opening is in said vertical longitudinal and median plane of said base plate.

23. The template defined by claim 22 wherein said nesting means and said complementary nesting means together comprise means for attaching said at least one lateral abutment and said at least one linkage arm to said base plate in two positions which are substantially symmetrical with respect to said vertical longitudinal and median plane of said base plate.

24. The template defined by claim 17 further comprising means for adjusting the position of said at least one lateral abutment on said at least one linkage arm.

25. The template defined by claim 24 wherein said at least one lateral abutment comprises a plate having a first opening therein for receiving said at least one linkage arm therethrough and a second threaded opening therein intersecting said first opening, wherein said adjusting means comprises a screw in said threaded opening, wherein said screw is of sufficient length to engage said at least one linkage arm in said first opening, thereby integrally attaching said plate to said at least one linkage arm.

26. The template defined by claim 17 wherein said linkage arm comprises a single shaft.

27. The template defined by claim 17 wherein said linkage arm comprises two substantially parallel shafts.

28. The template defined by claim 17 wherein said linkage arm comprises a shaft having a cross-sectional shape selected from the group consisting of: round, rectangular, square, and oblong.

29. The template defined by claim 17 wherein said at least one linkage arm further comprises a graduated scale thereon for facilitating adjustment of the transverse position of said template on said monoski.

30. The template defined by claim 7 wherein said at least one abutment is journalled on said base plate around a journal axis belonging to said vertical longitudinal and median plane of said base plate.

31. The template defined by claim 30 wherein said journal axis is a horizontal axis, wherein said template further comprises a linkage arm journalled on said base plate around said horizontal journal axis, wherein said linkage arm pivotally attaches said at least one abutment to said base plate around said horizontal journal axis.

32. The template defined by claim 31 further comprising a cap integral with said base plate and a journal pin horizontally mounted on said cap and attached to said at least one linkage arm for pivotally mounting said at least one abutment on said base plate around said horizontal journal axis.

33. The template defined by claim 31 wherein said support surface extends above and below said at least one linkage arm.

34. The template defined by claim 31 wherein the majority of said support surface extends from one side of said at least linkage arm, and wherein said at least one abutment is pivotally attached to said at least one linkage arm.

35. The template defined by claim 30 wherein said journal axis is a vertical pivot axis.

36. The template defined by claim 30 wherein said at least one linkage arm is pivotally mounted on said base plate around said vertical pivot axis.

37. The template defined by claim 17 further comprising:

means for attaching said at least one linkage arm to said base plate; and means for adjusting the position of said at least one linkage arm on said attaching means, wherein said at least one linkage arm is integrally attached to said at least one abutment.

38. The template defined by claim 37 wherein said at least one linkage arm comprises at least one shaft having a first end integrally attached to said at least one abutment, wherein said attaching means has an opening therein for receiving said shaft therein, wherein said template further comprises means for locking said shaft to said attaching means at a plurality of points on said shaft, whereby the position of said at least one linkage arm is adjustable with respect to said attaching means.

39. The template defined by claim 7 further comprising means for pinching said monoski over the width of said monoski, wherein said at least one lateral abutment comprises a portion of said pinching means.

40. The template defined by claim 7 further comprising means for pinching said monoski over the thickness of said monoski.

41. The template defined by claim 7 further comprising a substantially C-shaped rider journalled on said base plate around a substantially vertical axis, wherein said rider comprises a substantially vertical arm and upper and lower substantially horizontal arms, wherein said at least one lateral abutment comprises said vertical arm.

42. The template defined by claim 41 wherein said upper horizontal arm comprises a linkage arm supporting said rider on said base plate, wherein said rider is open in the direction of said base plate.

43. The template defined by claim 42 wherein said rider is vertically displaceable along said substantially vertical axis.

44. The template defined by claim 43 wherein said base plate comprises a lower surface, wherein said lower arm comprises an upper surface, wherein said rider comprises means for pinching the thickness of said monoski between said lower surface of said base plate and said upper surface of said lower arm of said rider.

45. The template defined by claim 44 further comprising means for elastically biasing said rider upwardly with respect to said base plate.

46. The template defined by claim 44 further comprising a shaft comprising a journal for pivotally attaching said rider to said base plate around said substantially vertical axis, wherein said shaft is attached to and extends upwardly from said base plate, wherein said upper arm of said rider has a vertically extending orifice therein for receiving said shaft.

47. The template defined by claim 46 further comprising means for controlling the vertical position of said rider with respect to said base plate, wherein said controlling means comprises a lever attached to said shaft.

48. The template defined by claim 47 wherein said upper arm of said rider comprises an upper surface, wherein said lever comprises a knob and a lower portion, wherein said lower portion comprises a cam adapted to contact said upper surface of said upper arm of said rider.

49. The template defined by claim 48 wherein said cam comprises a flattened portion, wherein said lever is adapted to be positioned in a lower position and in an upper position with respect to said base plate, wherein displacement of said lever changes the vertical position of said rider, wherein said lower arm of said rider is displaced to a maximum extent away from said base plate in response to positioning said lever in said lower position, wherein in said lower position said flattened portion contacts said upper surface of said upper arm of said rider, wherein said cam and said upper arm comprise means for placing said lever in a stable equilibrium position in response to contact between said flattened portion and said upper surface of said upper arm of said rider.

50. The template defined by claim 49 wherein said vertical arm comprises a projecting tongue projecting therefrom, wherein said tongue comprises a lateral side adapted to contact a lateral edge of said base plate, wherein said tongue comprises means for aligning said lateral side of said tongue with said lateral edge of said base plate when the distance between said lower surface of said base plate and said upper surface of said lower arm of said rider is approximately equal to the thickness of said monoski.

51. The template defined by claim 50 wherein said tongue comprises an upper portion comprising a chamfered surface.

52. The template defined by claim 41 further comprising a secondary abutment, wherein said support surface comprises a surface of said secondary abutment, wherein said support surface is oriented toward said base plate, wherein said secondary abutment is displaceably mounted on said base plate so that the transverse position of said secondary abutment with respect to said base plate is adjustable.

53. A template for boring orifices in a ski comprising:

(a) a base plate;

(b) means associated with said base plate for positioning a plurality of boring-tool receiving orifices in a pattern to allow for boring a sufficient number of orifices in a ski to allow for securing a binding to a single-binding assembly ski and for securing a two binding assembly onto a monoski;

(c) means associated with said base plate allowing for removable attachment of at least one pinching means for attaching said base plate to said ski having said one binding assembly and for removably attaching at least one lateral abutment to allow for attachment of said base plate to said monoski, said lateral abutment being displaceable between substantially symmetrical first and second positions.

54. The template defined by claim 53 in combination with said lateral abutments.

55. A method of boring orifices in a ski for the attachment of elements thereto using a template comprising a base plate comprising at least one boring barrel thereon and at least one lateral abutment having a support surface thereon, wherein said method comprises the steps of:

(a) positioning said base plate on one side of the longitudinal median axis of said ski;

(b) positioning said at least one lateral abutment on one side of the longitudinal median axis of said ski and on one side of the longitudinal vertical and median plane of said base plate so that a support surface of said at least one lateral abutment abuts a lateral side of said ski;

(c) making at least one orifice in said ski at a point on said ski determined by said at least one boring barrel;

(d) displacing said base plate to a position on the other side of and substantailly symmetrical to the longitudinal median axis of said ski;

(e) displacing said at least one lateral abutment of said template to a position on the other side of and substantially symmetrical to the longitudinal vertical and median plane of the base plate so that said support surface of said at least one lateral abutment abuts the other lateral side of said ski; and (f) making another orifice in said ski at a point determined by said at least one boring barrel.

56. The method defined by claim 55 wherein said base plate comprises a plurality of boring barrels and two lateral abutments, wherein step (b) comprises the step of positioning said two lateral abutments on one side of said longitudinal median axis of said ski and on one side of said longitudinal vertical and median plane of said base plate so that support surfaces on said two lateral abutments abut a lateral side of said ski, wherein step (c) comprises the step of making a plurality of orifices in said ski at points on said ski determined by said plurality of boring barrels, wherein step (e) comprises the step of displacing said two lateral abutments to a position on the other side of and substantially symmetrical to the longitudinal vertical and median plane of the base plate so that said support surfaces of said two lateral abutment abut the other lateral side of said ski, wherein step (f) comprises the step of making another plurality of orifices in said ski at points determined by said plurality of boring barrels.

57. The method defined by claim 55 wherein steps (c) and (f) comprise the steps of extending a drull through said at least one boring barrel and drilling said orifice in said ski.

58. The method defined by claim 55 wherein step (d) comprises the step of linearly displacing said base plate transversely to said longitudinal median axis of said ski to a position on the other side of and substantailly symmetrical to the longitudinal median axis of said ski.

59. The method defined by claim 55 wherein step (b) comprises the step of inserting first and second shafts of a plug attached to said at least one lateral abutment into first and second orifices, respectively, in a block on said base plate, wherein step (e) comprises the step of disengaging said first and second shafts from said first and second orifices, respectively, and inserting said first shaft into said second orifice and inserting said second shaft into said first orifice so as to displacing said at least one lateral abutment of said template to a position on the other side of and substantially symmetrical to the longitudinal vertical and median plane of the base plate so that said suppport surface of said at least one lateral abutment abuts the other lateral side of said ski.

60. The method defined by claim 55 wherein step (e) comprises the step of pivoting said at least one abutment around an axis so as to displace said at least one lateral abutment of said template to a position on the other side of and substantially symmetrical to the longitudinal vertical and median plane of the base plate so that said support surface of said at least one lateral abutment abuts the other lateral side of said ski.

61. The method defined by claim 60 wherein step (e) comprises pivoting said at least one abutment around a vertical axis.

62. The method defined by claim 60 wherein step (e) comprises pivoting said at least one abutment around a horizontal axis.

63. The method defined by claim 55 further comprising the steps of pinching said base plate on said monoski before step (c) and again after step (d).

* * * * *

UNITED STATES PATENT AND TRADEMARK OFFICE

CERTIFICATE OF CORRECTION

PATENT NO. : 4,753,557

DATED : June 28, 1988

INVENTOR(S) : Bertrand BESNIER

It is certified that error appears in the above-identified patent and that said Letters Patent is hereby corrected as shown below:

At column 1, line 21, change "singleelement" to —single-element—.

At column 1, line 46, insert —,— after "i.e.".

At column 1, line 64, change "and" to —the—.

At column 3, line 5, insert —,— after "embodiment".

At column 3, line 8, insert —,— after "position".

At column 3, line 11, insert —,— after "position.

At column 3, line 60, change "halfplates" to —half-plates—.

At column 3, lines 64-65, insert —,— after "embodiment".

At column 4, line 4, change "longituidnal" to —longitudinal—.

At column 4, line 7, insert —,— after "embodiment".

At column 4, line 29, change "addition,the" to —addition, the—.

At column 4, line 45, insert —,— after "embodiment".

At column 4, line 46, insert —,— after "embodiment".

At column 4, line 48, insert —,— after "embodiment".

At column 4, line 51, insert —,— after "embodiment".

At column 4, line 55, insert —,— after "embodiment".

At column 5, line 4, insert —one— before "linkage".

At column 5, line 6, insert —,— after "embodiment".

At column 5, line 10, insert —,— after "embodiment".

At column 5, line 24, insert —,— after "embodiment".

UNITED STATES PATENT AND TRADEMARK OFFICE

CERTIFICATE OF CORRECTION

PATENT NO. : 4,753,557

DATED : June 28, 1988

INVENTOR(S) : Bertrand BESNIER

It is certified that error appears in the above-identified patent and that said Letters Patent is hereby corrected as shown below:

At column 5, line 30, insert —,— after "embodiment".
At column 6, line 15, insert —,— after "embodiment".
At column 6, line 22, insert —,— after "embodiment".
At column 6, line 63, insert —,— after "embodiment".
At column 6, line 65, insert —,— after "embodiment".
At column 7, line 9, change "abutment" to —abutments—.
At column 7, line 13, insert —,— after "embodiment".
At column 7, line 16, insert —,— after "embodiment".
At column 7, line 21, insert —,— after "embodiment".
At column 7, line 25, insert —,— after "embodiment".
At column 7, line 30, change "displacing" to —displace—.
At column 7, line 36, insert —,— after "embodiment".
At column 8, line 16, change "outlines" to —outlined—.
At column 8, line 36, insert —,— after "i.e.".
At column 8, line 41, insert —,— after "i.e.".
At column 9, line 29, insert —,— after "embodiment".
At column 9, line 44, insert —,— after "positions".
At column 9, line 54, insert —,— after "3".
At column 9, line 61, insert —,— after "20".
At column 10, line 39, change "8,9" to —8, 9—.
At column 10, line 52, insert —,— after "position".
At column 10, line 55, change "8,9" to —8, 9—.
At column 10, line 57, change "8,9" to —8, 9—.
At column 10, line 66, insert —,— after "2".
At column 11, line 2, delete "," after "second".

UNITED STATES PATENT AND TRADEMARK OFFICE

CERTIFICATE OF CORRECTION

PATENT NO. : 4,753,557

DATED : June 28, 1988

INVENTOR(S) : Bertrand BESNIER

It is certified that error appears in the above-identified patent and that said Letters Patent is hereby corrected as shown below:

At column 11, line 6, change "100,101" to —100, 101—.
At column 11, line 16, change "a" to —an—.
At column 11, line 30, insert —,— after "3-7".
At column 11, line 38, insert —,— after "positions".
At column 12, line 3, insert —,— after "19".
At column 12, line 4, insert —,— after "3A".
At column 12, line 6, insert —,— after "19".
At column 12, line 19, change "arm" to —arms—.
At column 12, line 30, insert —,— after "17" and after "9".
At column 12, line 30, change "samll" to —small—.
At column 12, line 33, insert —,— after "accomplished" and after "example".
At column 12, line 35, insert —,— after "4A".
At column 12, line 37, change "of" to —or—.
At column 12, line 38, change "is" to —it—.
At column 12, line 64, insert —,— after "width".
At column 13, line 11, insert —,— after "axis".
At column 13, line 20, change "arm" to —arms— (second occurrence).
At column 13, line 56, change "ofo" to —of—.
At column 14, line 16, change "chambered" to —chamfered—.
At column 14, line 59, change "assembles" to —assemblies—.
At column 15, line 8, insert —,— after "example".

UNITED STATES PATENT AND TRADEMARK OFFICE

CERTIFICATE OF CORRECTION

PATENT NO. : 4,753,557

DATED : June 28, 1988

INVENTOR(S) : Bertrand BESNIER

It is certified that error appears in the above-identified patent and that said Letters Patent is hereby corrected as shown below:

At column 15, line 65, claim 3, line 10, insert ---in--- after "wherein".

At column 21, line 18, change "displacing" to ---displace---.

Signed and Sealed this

Sixteenth Day of July, 1991

*Attest:*

*Attesting Officer*

HARRY F. MANBECK, JR.

*Commissioner of Patents and Trademarks*